US005746427A

United States Patent [19]

Hamid

[11] Patent Number: 5,746,427

[45] Date of Patent: May 5, 1998

[54] ROLLER TYPE STACKER AND METHOD FOR STACKING PIECES OF LIMP MATERIAL

[75] Inventor: Hadi Muzaffar Nayyer Hamid, New Hartford, N.Y.

[73] Assignee: Jet Sew Technologies, Inc., Bowling Green, Ky.

[21] Appl. No.: 533,858

[22] Filed: Sep. 26, 1995

[51] Int. Cl.[6] ..... B65H 43/00

[52] U.S. Cl. ..... 271/176; 271/182; 271/214; 271/217

[58] Field of Search ..... 271/182, 214, 271/215, 217, 176, 220

[56] References Cited

U.S. PATENT DOCUMENTS

| | | | |
|---|---|---|---|
| 3,918,700 | 11/1975 | Donner . | |
| 3,955,812 | 5/1976 | Suda et al. . | |
| 4,051,957 | 10/1977 | Parups . | |
| 4,712,787 | 12/1987 | Princiotta, Sr. et al. . | |
| 4,865,309 | 9/1989 | Beasock et al. | 271/176 X |
| 5,082,267 | 1/1992 | Sanborn, III . | |
| 5,098,079 | 3/1992 | Sanborn, III . | |
| 5,174,558 | 12/1992 | Sanborn, III . | |
| 5,499,564 | 3/1996 | Sanborn, III et al. | 271/217 X |

*Primary Examiner*—David H. Bollinger

[57] ABSTRACT

An apparatus for transferring workpieces to a stack from an endless conveyor having a plurality of forward traveling flights in a defined path. The conveyor being composed of a series of flights spaced at intervals there along. Each flight being constructed for carrying one of the workpiece 3. The apparatus and method include using a stacking mechanism for supporting a stack of limp materials removed from the forward advancing flights positioned below the path of the traveling flights. The stacking mechanism works in combination with a holding mechanism which determines the position of the upper most ply in the stack. A transfer mechanism is used for removing each ply from a forward advancing flight of the conveyor for transfer to the stack supported by the stacking mechanism. The transfer mechanism includes a rotatable engaging mechanism for engaging individual workpieces against the upper surface of a forward moving light so that the rotational speed of the rotatable engaging member substantially assumes the longitudinal speed of the forward advancing flight. At a predetermined time, a braking mechanism is used for stopping the rotation of the rotatable fabric engaging mechanism for stopping the forward movement of the workpiece as the forward moving flight continues out from under the for dragging it onto the supported stack.

16 Claims, 8 Drawing Sheets

ROLLER TYPE STACKER AND METHOD FOR STACKING PIECES OF LIMP MATERIAL

BACKGROUND OF THE INVENTION

1. Technical Field of the Invention

This invention generally relates to an apparatus and method for automatically stacking a plurality of workpieces, especially limp material workpieces, using a roller type stacker by transferring the workpieces from a moving conveyor having a plurality of workpiece supporting flights with spaces therebetween.

2. Description of the Related Art

Many different types of stacking machines and methods are currently used in the apparel industry for transferring and stacking workpieces taken from automated machines or conveyor systems. There are generally two approaches to these transferring and stacking systems.

The first approach provides that the workpieces may be transferred from a machine and stacked in a random and disorganized fashion. These stacks are acceptable when the next operation allows an operator to manually remove a workpiece from the stack and position it on the next machine. However, this approach will not work when the stacks are to be loaded in an automated system that cannot compensate for deviations in the plies that compose the stack. To accommodate such automated systems, systems made consistent with the second approach creates a "virgin" stack in which the plies are neatly and uniformly arranged. Stacking machines which produce virgin stacks typically include devices that grasp or pick the fabric plies so that they may be precisely controlled when creating the stack. One such device is shown in U.S. Pat. No. 4,157,823, entitled METHOD AND MEANS FOR TRANSPORTING AND ORIENTING LIMP PLIES OF FABRIC AND THE LIKE. Many of these machines share the inherent problem of forming a stack where the workpieces are wrinkled, creased, or are otherwise damaged.

One example of a conventional system which transfers pieces of limp material from a flighted conveyor for creating a stack is shown in U.S. Pat. No. 5,098,079 to Sanborn, III entitled APPARATUS FOR STACKING PIECES OF LIMP MATERIAL. In the Sanborn apparatus, two separate mechanisms are used for removing workpieces from a moving conveyor and onto a stack.

In the first mechanism shown in FIGS. 4–7 of the '079 Sanborn, III reference, a pair of retractable pins 106 engage one end of a workpiece positioned on a forward traveling flight composed of a plurality of transversely arranged rods. The pins trap the end of the workpiece against a corresponding finger 114 to stop the forward movement of the workpiece as the flight continues forward. As the trailing edge of the flight moves beyond the stack, the workpiece falls onto the top of the stack and the pins are retracted to allow a hold-down finger to secure the workpiece against the other workpieces composing the stack.

This same patent shows an alternative transfer and stacking mechanism in FIGS. 9 and 10 which also performs to stop the forward movement of a workpiece for removing it from an advancing flight. In this embodiment, a foam rubber pad 207 engages the moving workpiece for stopping its forward motion as the flight continues onward. Similar to the prior embodiment discussed above, the foam rubber pad 207 urges the workpiece downward onto the stack where the hold-down finger secures it against the other plies in the stack S.

As with other similar apparatus, a problem with both of the Sanborn transfer and stacking mechanisms is that the pin system and the foam rubber pad system cause wrinkles, creases and bunching of the fabric plies as they are removed from the forward advancing flights.

There is currently no available transfer and stacker system which can consistently and reliably transfer workpieces, especially limp material workpieces, from a flighted conveyor onto a supporting surface for creating a virgin stack without the problems discussed above. Conventional systems are unable to sufficiently control the position of the individual workpieces as each is transferred from the flighted conveyor to the stack. Further, many systems which use pins or other types of mechanisms are unsafe for the operator. Thus, there is a need in the industry for an apparatus and method which can efficiently and reliably transfer pieces of material from a moving flighted conveyor to a stacking mechanism.

SUMMARY OF THE INVENTION

It is an object of the present invention to provide an automatic stacking apparatus and method which reliably transfers pieces of material from a moving flighted conveyor to a stacking mechanism.

It is another object of the present invention to provide a stacking and transfer apparatus and method which reliably and safely transfers pieces of limp material from a flighted conveyor without wrinkles or creases.

It is a further object of the invention to provide a method and apparatus for consistently stacking single ply workpieces of limp material one on top of another transferred from a moving flighted endless conveyor.

It is another object of the present invention to provide an apparatus and method that can stack workpieces of different material thicknesses without significant adjustments.

It is another object of the present invention to provide a method and apparatus that can stack a plurality of flat plies of different shapes.

It is yet another feature of the invention to provide an apparatus and method which can transfer workpieces from a flighted conveyor even when the position of the conveyor flights may be consistent with respect to the transfer mechanism.

Thus, the present application is directed to an apparatus for stacking workpieces from an endless conveyor with a plurality of flights that travel in a defined path. The flights are spaced at intervals there along wherein each flight is constructed for carrying one of said workpieces. A stacking mechanism supports a plurality of pieces of material and is positioned below the upper reach and along the length of the conveyor. A hold-down mechanism cooperates with the stacking mechanism in monitoring the position of the top ply in the stack of material as additional workpieces are transferred from the conveyor to the stack. Finally, a transferring mechanism is used for removing pieces of material from the upper surface of the forward moving flights to the stack by engaging the upwardly facing surface of a workpiece as supported on a flight. The workpiece is engaged by a rotatable workpiece engaging system which, rotates at a speed substantially consistently with the longitudinal speed of the forward moving flight when engaging the workpiece supported by the forward moving flight. A braking means is activated to stop the rotation of the rotatable workpiece engaging system in order to correspondingly stop the forward movement of the engaged workpiece. Thus, as the flight moves forward, the workpiece is left behind, and is urged against the top of the stack by the workpiece engaging means.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and, thus are not limitative of the present invention, and wherein.

DESCRIPTION OF THE PREFERRED EMBODIMENTS

Figure 1:
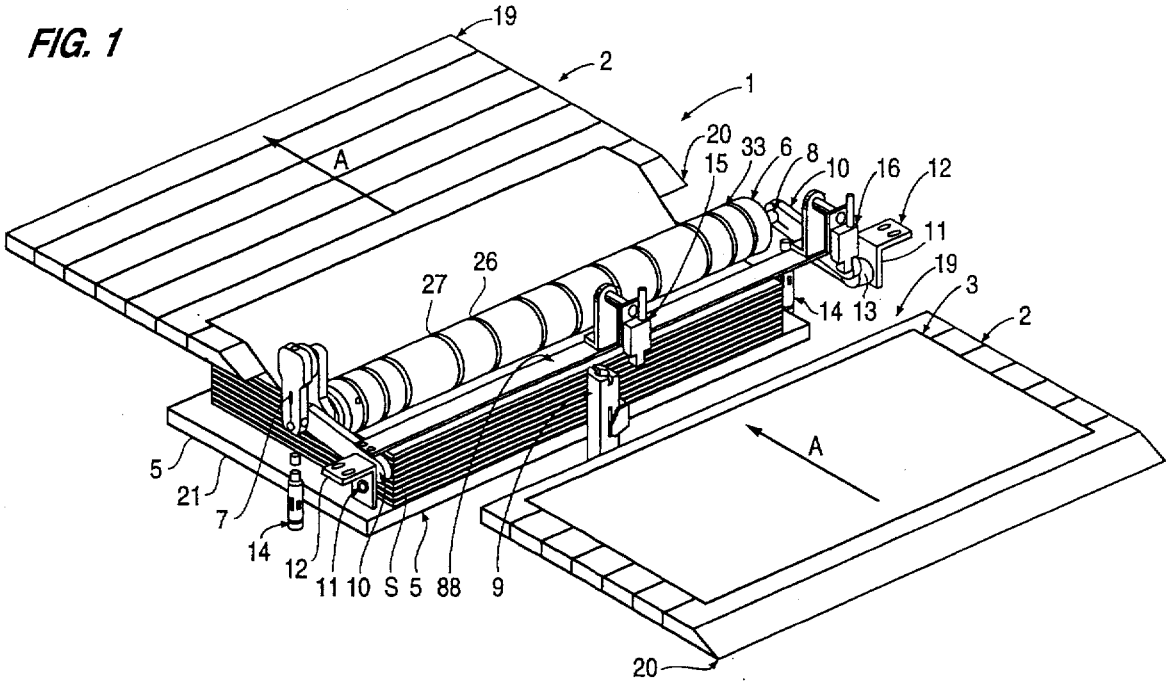
FIG. 1 is a perspective view of a roller type stacker for transferring and stacking workpieces from a flighted conveyor in accordance with one preferred embodiment of the present invention.

FIG. 1 contains a perspective view of the roller type stacker assembly 1 according to one preferred embodiment of the present invention. The roller type stacker assembly 1 is particularly designed for use with an endless conveyor having a plurality of flights 2 with spaces therebetween which travel in a defined path. An example of an endless conveyor system is described in U.S. Pat. No. 5,082,268 by Sanborn, III, dated Jan. 21, 1992, entitled, AUTOMATIC FEEDER FOR WORKPIECES OF LIMP MATERIAL, the details of which are herein incorporated by reference for the purpose of teaching one type of an endless conveyor system with spaced flights that travel in a defined path.

FIG. 1 shows two conveyor flights 2. The first flight 2 is shown as moving in the direction of arrow A toward the roller type stacker assembly 1 loaded with a workpiece 3 and the second flight 2 is unloaded and moving away from the roller type stacker assembly 1 in the same direction. Each of the conveyor flights 2 has a leading edge 19 and a trailing edge 20. The leading edge 19 is the portion of the flight which first approaches the roller type stacker assembly 1 as it is advanced by the conveyor. The trailing edge 20 of each of the conveyor flights 2 is the edge of the flight opposite the leading edge 19. As explained more fully hereinafter, the trailing edge 20 is angled to facilitate easy removal of a supported workpiece from the upper surface of a flight by the roller type stacker assembly 1. Each conveyor flight 2 is designed to support a single workpiece 3 on the upper surface of the flight.

The conveyor flights 2 in FIG. 1 are shown as being defined by a collection of slats. However, the disclosed invention is designed to transfer and to stack workpieces from flights having alternative flight constructions not limited to flights with slats. Finally, each of the conveyor flights 2 is spaced from one another along the endless conveyor. The disclosed invention works with conveyors having regular or irregular spaced flights.

The roller type stacker assembly 1 includes a roller 6 for engaging the workpiece 3 supported by a conveyor flight 2 as it travels by the roller type stacker assembly 1. The roller 6 is cylindrically shaped and has a length which is greater than the width of the workpiece 3. In a preferred embodiment, the roller 6 has a base comprises of an aluminum tube and a plurality of O-rings 27. Grooves 26 are formed in the circumferential surface of the roller 6 for receiving corresponding O-rings 27, one of which permanently resides within each of the grooves 26. An adhesive may be applied to the O-rings 27 to hold them in place. The O-rings 27 may have either a flat cross-section that requires a rectangular groove or a round cross-section that requires a circular groove.

The O-rings 27 perform two functions with respect to the roller 6. First, the O-rings 27 are seated in the circular groove 26 such that a portion of each of the O-rings 27 extends above the circumferential surface of the roller 6 for acting as a shock absorbing mechanism as the roller 6 engages the workpiece 3 on a forward moving conveyor flight 2. Second, the O-rings 27 also act to increase the frictional contact between the roller 6 and a forwardly traveling flight to promote rotation of the roller 6 at a speed consistent with the forward speed of the advancing flight and to improve the contact between the roller 6 and an engaged workpiece supported on a flight.

In an alternative embodiment, the roller 6 may also be made of cast urethane 1 or other pliable material, which is ground to a selected outer diameter, that possesses the same shock absorbing properties and contact enhancing attributes of the O-rings 27 on the aluminum tubing embodiment. Other types of materials may likewise be used to form the roller 6, or its constituent parts.

A shaft 8 is positioned within a cylindrical bore that extends through the center of the roller 6. The roller 6 can turn freely on the shaft 8. This is an important aspect of the invention in that when the roller 6 contacts a workpiece 3 loaded on a forward moving flight, the roller 6 turns without inhibition for assuming a rotational speed consistent with the longitudinal speed of the forward moving flight before it contacts the workpiece supported on the flight. As with the shock absorbing properties of the roller 6, the ability of the roller 6 to freely turn as it engages the workpiece 3 assists in preventing wrinkles, creases and misdirection of the workpiece as it is being transferred to the stack.

The shaft 8 and roller 6 are supported to rotate freely between a pair of pivot arms 10. The pivot arms 10 each pivot about a support shaft 11 when moving the roller 6 between a position with at least the equator of the roller 6 above the defined path of the moving flights to a position, at least partially, below the path of the moving flights. Each of the pivot arms 10 is mounted on a mounting bracket 12 which may be manufactured to make the roller type stacker assembly 1 an independent device or for incorporating it into a newly manufactured conveyor system having a plurality of flights with spacing therebetween.

In one preferred embodiment, the roller 6 turns freely on the shaft 8 as it is securely held in place by the pivot arms 10. However, the shaft 8 may be integrally formed as part of the roller 6 or secured within the cylindrical bore so that the two elements move as a single unit. In such an embodiment, the pivot arms 10 may be equipped with bearings (or some other mechanism) for allowing the shaft 8 to turn freely while supported by the pivot arms 10.

One of the problems associated with engaging the forward moving flight which may lead to misalignment or damage of the workpieces during the transferring and stacking operations is that the roller 6 may skip or vibrate from impact with the moving flight or the workpiece supported on the upper surface of the moving flight. If the roller 6 vibrates or bounces on the supporting flight, wrinkles, creases or other damage to the workpiece 3 may occur before it is transferred to the stacking mechanism.

In addition to the O-rings 27, the present invention includes a torsion spring 13 which, inter alia, performs to dampen vibration of the roller 6 during the transfer process. The torsion spring 13 is located between one of the mounting pieces 12 and pivot arms 10. One of the support shafts 11 serves as a mandrel for torsion spring 13 as shown in FIGS. 1 and 2.

First, the torsion spring 13 urges one of the pivot arms 10 downward for bringing the roller 6 against a forwardly traveling flight 2 and workpiece 3 in a path that ultimately results in the workpiece 3 being transferred to the stack S. Second, the torsion spring 13 helps to reduce any jumping of the roller 6 by absorbing the force generated upon initial contact with a flight 2 and by dampening the vibration of the roller 6 as it continues to ride along the upper surface of a flight 2.

In some cases, the upper surface of the flight 2 may not be uniformly shaped or some deviation of the flights 2 from the defined path may occur that creates vibration of the roller 6. The torsion spring 6 produces sufficient force to dampen vibrations of the roller 6 in such cases while maintaining it in contact with the workpiece 3 during the transfer process.

Although a single torsion spring 13 is shown in the illustrated embodiment, multiple torsion springs or other mechanisms may be used for urging the roller 6 into engagement with the forward moving flights and toward the stacking mechanism while lessening the adverse affects of roller vibration and skipping.

Double-acting pneumatic cylinders 14 are used for urging the pivot arms 10 upward to raise the roller 6 to a position for engaging the forward moving flights. The double-acting cylinders 14 have sufficient force to overcome the opposing force of the torsion spring 13. In the preferred embodiment, double-acting cylinders 14 are disposed on each side of the roller type stacker assembly 1. However, a single cylinder may be used. Further, similar type devices may be disposed on one or both pivot arms 10 for affecting movement of the roller 6.

Figure 3:
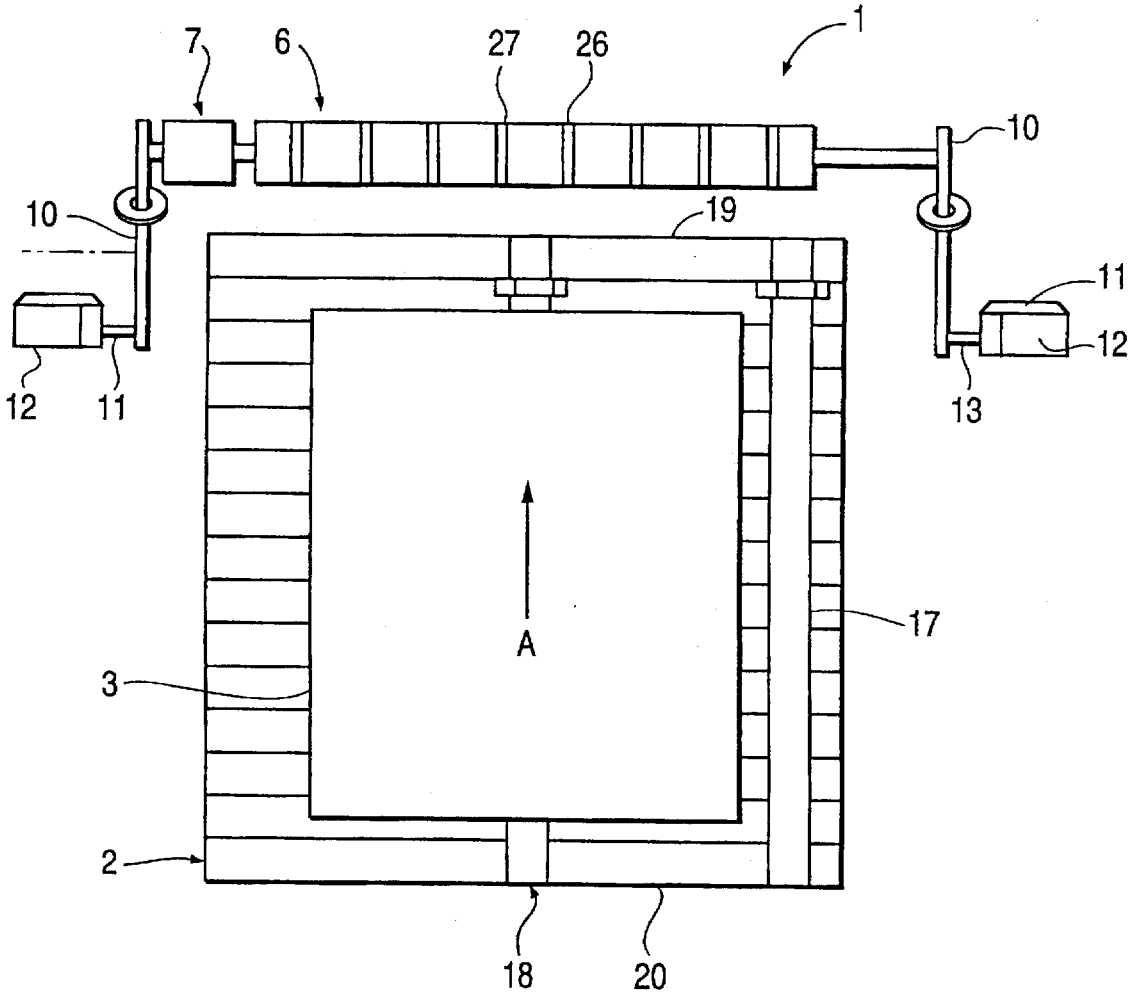
FIG. 3 is a plan view of the apparatus shown in FIG. 1.

The roller type stacker assembly 1 also includes a brake 7. As shown in FIG. 3, the brake 7 is positioned between one of the pivot arms 10 and the roller 6 for engaging the shaft 8. The brake 7 may be positioned at various locations in the roller type stack assembly 1 provided that it can operatively engage the roller 6 or shaft 8 for stopping the rotation of the roller 6 once it engages a workpiece.

The brake 7 is connected to the controller 4 (see FIG. 5) which activates the brake 7 for stopping rotation of the roller 6. As discussed previously, once the roller 6 engages a workpiece 3, the rotational speed of the roller 6 becomes substantially consistent with the longitudinal speed of the forward moving conveyor flights 2. At a predetermined event, the controller 4 activates the brake 7 for stopping rotation of the roller 6. The braked roller 6 remains in contact with the workpiece 3 for preventing the forward movement of the engaged workpiece 3 as the forward moving conveyor flight 2 continues out from under the workpiece 3. The force of the torsion spring 13 on the pivot arm 10 causes the roller 6 to move downward for dragging the workpiece 3 across the upper surface of the flight and onto the stack below. The plurality of O-rings 27 also improve the contact between the roller 6 and the engaged workpiece for overcoming any friction between the upper surface of the supporting flight and the workpiece.

Figure 7A:
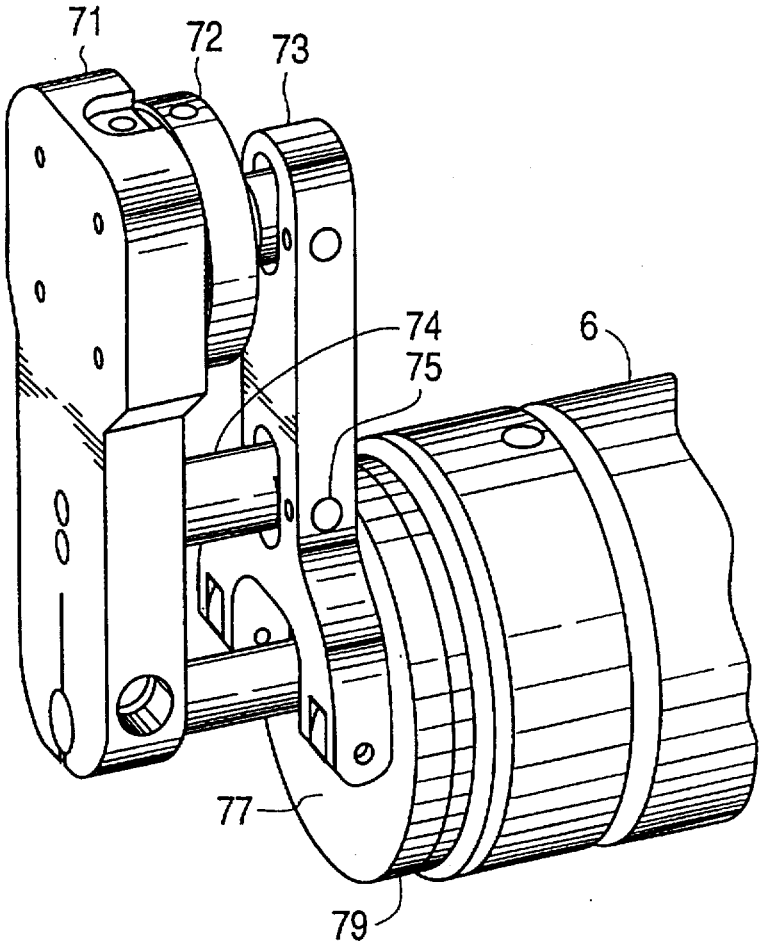
FIGS. 7A and 7B are side and sectional views of a braking system according to one preferred embodiment of the present invention.
Figure 7B:
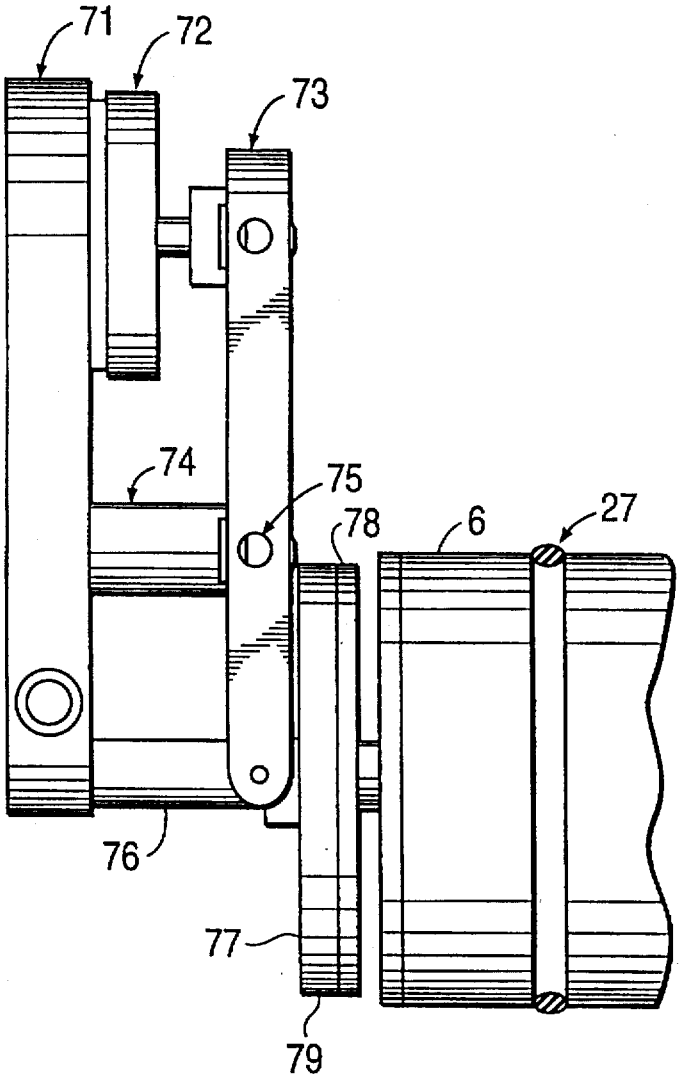

Details of the brake 7 are shown in FIGS. 7A and 7B. The brake 7 includes a mounting bracket 71 which supports a cylinder 72. A yoke 73 is connected to the cylinder 72 and affixed to the mounting bracket 71 by pivot post 74. The yoke pivots around a central pivot point 75 to engage and disengage the brake 7. One end of the yoke is connected to the cylinder 72 by a post 76. The other end of the yoke 73 is connected to a shaft 76 on which the brake mechanism 77 is mounted. The brake mechanism includes braking material 78 aligned with one end of the roller 6 for engaging the end of the roller upon actuation of the cylinder 72. In operation, the pneumatic cylinder 72 extends the rod 76 to pivot the yoke 73. As the yoke pivots, the end plate 79 supporting the brake material 78 engages the end of the roller 6 causing frictional contact between the roller 6 and the brake material. This frictional contact causes the roller 6 to stop.

In the illustrated embodiment, the brake 7 is a pneumatic braking system. Although a pneumatic brake system is preferred, other types of braking systems may be used such as an electric brake system. An example of an acceptable electric brake is manufactured and sold by Inertia Dynamics of Collinsville, Conn.

Two separate detectors are used in combination with the controller 4 for controlling the system. Workpiece sensor 15 is used to detect the leading and trailing edges of a workpiece 3 on the upper surface of a forward moving conveyor flight 2 as it approaches the roller type stacker assembly 1. In addition, a flight sensor 16 disposed to one side of the workpiece sensor 15 detects the leading and trailing ends of a forward moving conveyor flight 2. Both optical sensors are mounted above the defined path of the conveyor on support beam 88.

In the preferred embodiment, both the flight sensor 16 and workpiece sensor 15 are optical sensors which detect the reflection of light. As shown in FIG. 3, two separate areas of reflective material 17,18 are disposed on the upper surface of each of the conveyor flights 2 comprising the conveyor. In one embodiment, the first reflective material 17 and the second reflective material 18 forms two strips spaced apart on the upper surface of each individual conveyor flight. One reflective area 18 is aligned with the workpiece sensor 15 and the other reflective area 17 is aligned with the flight sensor 16. The reflectors operate to detect a certain level of reflected light.

The areas of reflective material are also useful in ensuring that the detectors are properly aligned. The level of reflectance will be lower if a flight or detector is misaligned so that the sensors detect light reflected from some area of the advancing flight other than the reflective areas. This condition may be monitored to alert the operator of a potential misalignment or malfunction.

The reflective areas in FIG. 3 may be created using a reflective tape. However, any other reflective material may be used to create the reflective areas.

While optical sensors are shown, other types of detecting mechanisms for accomplishing the same result may also be used in combination with the controller 4 to detect movement of the roller 6 with respect to the forward moving flights and the presence of a workpiece 3.

Figure 4:
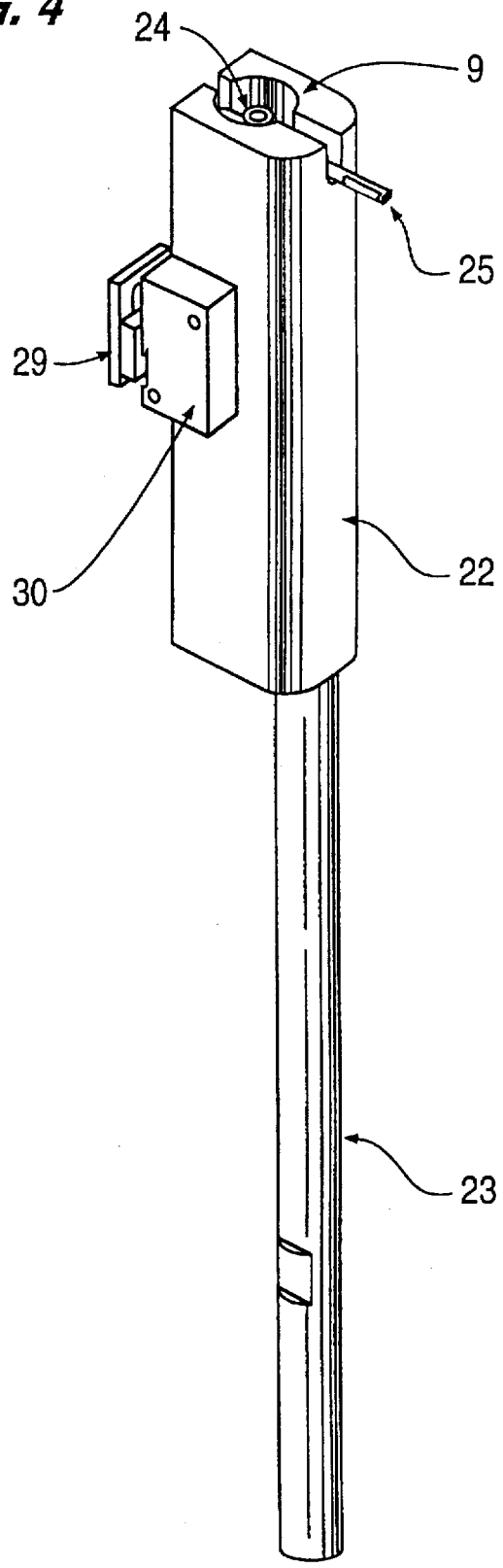
FIG. 4 is a perspective side view of a hold-down finger assembly as shown in FIG. 1.

As shown in FIGS. 1, 2 and 4, the roller type stacker assembly 1 also includes a stacker 5 and a hold-down mechanism 9 for hosting a stack of workpieces 3 as they are removed from the forward moving conveyor flights 2 of the conveyor system by the roller 6. The stacker 5 and hold-down mechanism 9 are disposed below the defined path of the moving conveyor flights 2 along a portion of the conveyor system proximate to the roller type stacker assembly 1.

The stacker 5 includes an elevator 21 having a stack supporting surface which raises and lowers the stacker 5 in response to the controller 4. The stack supporting surface is aligned substantially parallel and below a plane collectively defined by the defined path of the forward moving conveyor flights 2. The stacker 5 maintains the top of the stack only slightly below the moving conveyor for receiving workpieces 3 engaged by the roller 6 as they are dragged from the advancing conveyor flights 2 (details of this operation are explained hereinbelow).

Cooperating with the stacker 5 is a hold-down mechanism 9. The hold-down mechanism 9 determines the height of the stack which information the controller 4 uses to raise or lower the elevator 21. The hold-down mechanism 9 includes a guide chamber 22 made of aluminum or other type of suitable base material for accommodating a mounting shaft 23 which is attached to the guide chamber 22. A spring loaded plunger 24 is positioned in a cylindrical bore (not shown) within the guide chamber 22. A hold-down finger 25 is attached to one end of the plunger 24. As the stacker 5 raises the stack by activation of the elevator 21, the hold-down finger and plunger 24 move upward against the spring resistance. This movement is detected by an actuator arm 29 attached to the plunger 24 which causes a proximity switch 30 to transmit the position of the plunger 24 to the controller 4. This mechanism is important for ensuring that the upper workpiece of the stack S is in a proper position with respect to the defined path of the flights before the roller 6 transfers the next workpiece.

Figure 5:
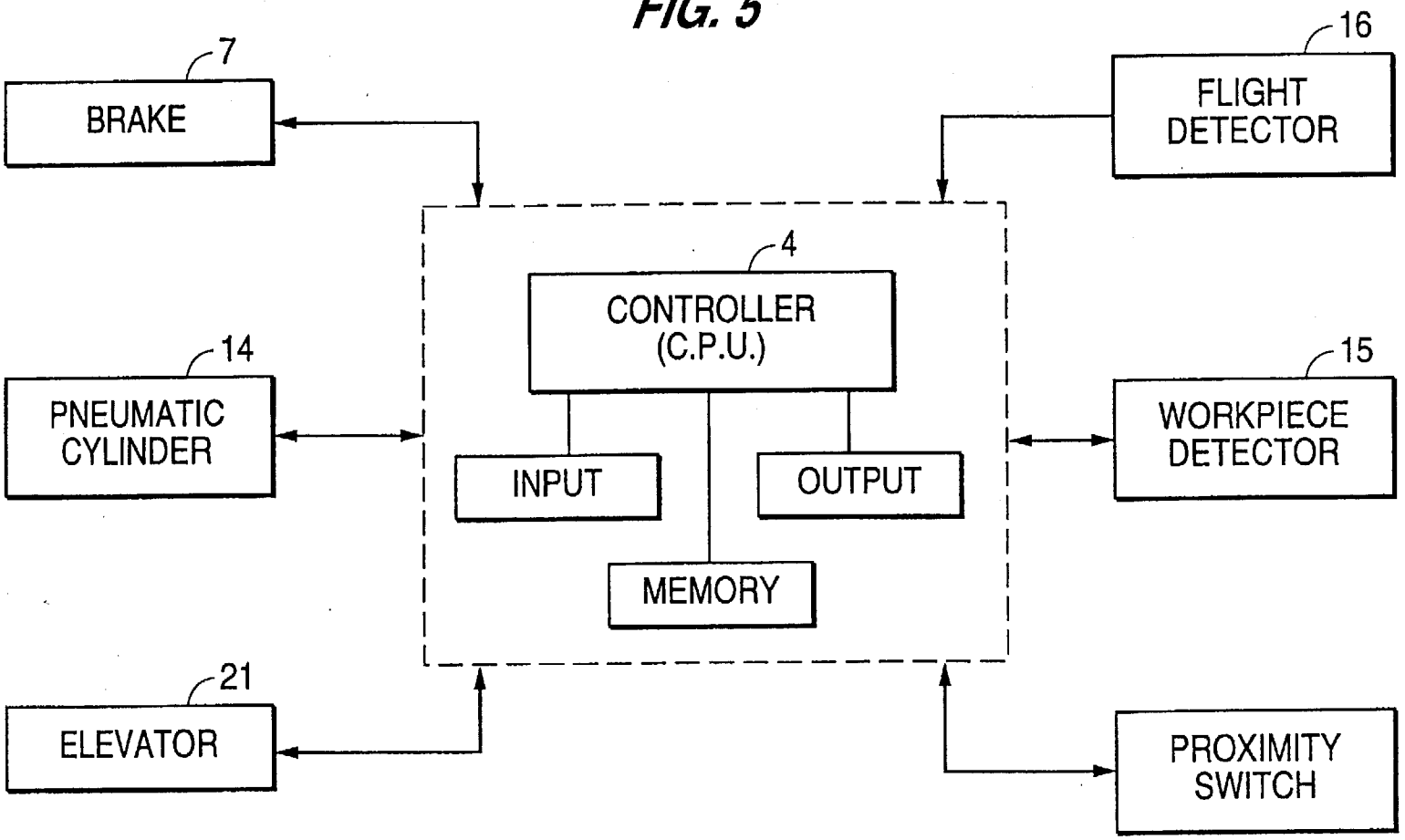
FIG. 5 is a schematic diagram which shows the relationship between the controller and other elements of the roller type stacker.
Figure 6:
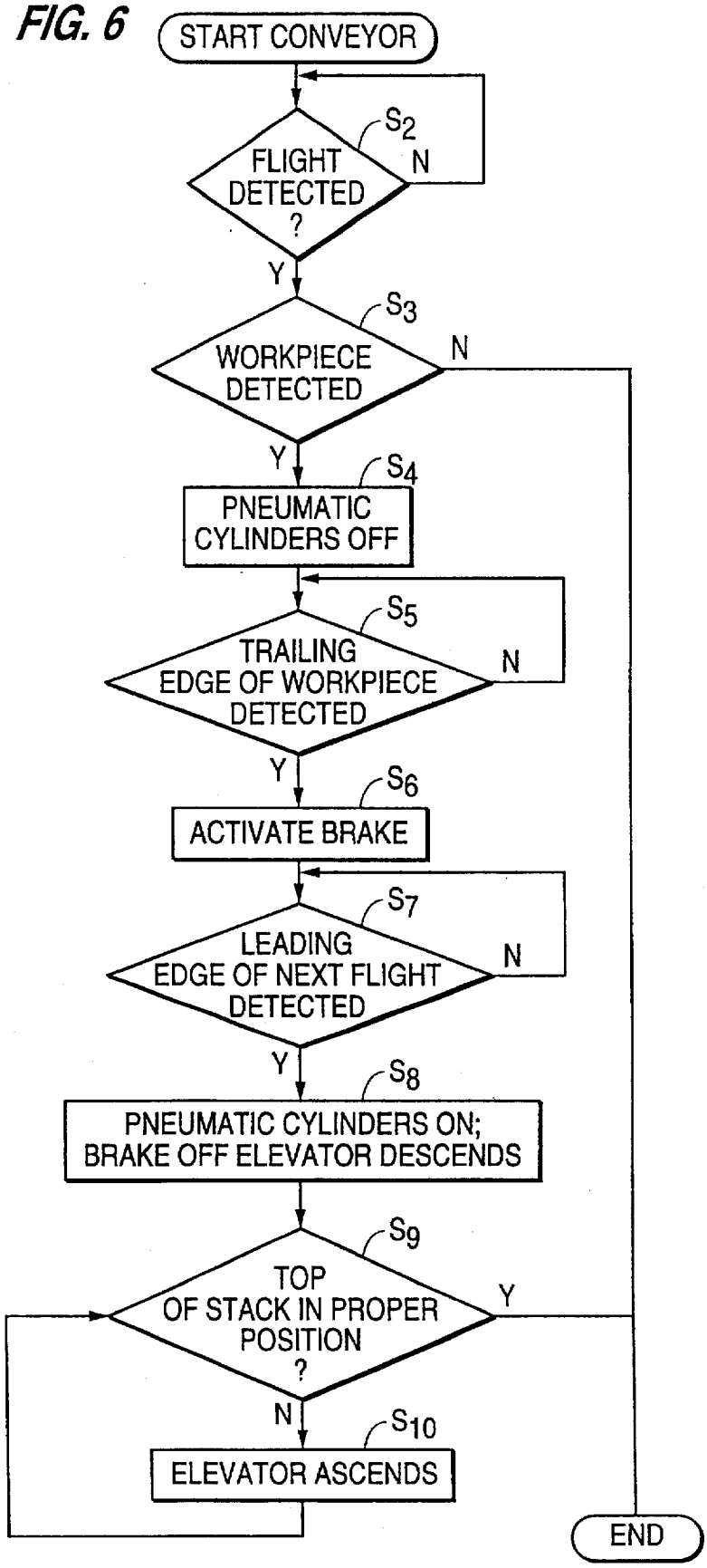
FIG. 6 is a flow chart illustrating the sequence of events which occurs during operation of the roller type stacker and method in cooperation with FIGS. 2(A)–2(G)

As shown in FIG. 5, the controller 4 (with an input device, output device and memory) is operatively connected to the proximity switch 30, flight sensor 16, workpiece sensor 15, elevator 21 and double-acting cylinders 14 to coordinate the functions of the various elements in engaging a workpiece to be transferred and stacked. Other elements may be added to the illustrated system for performing related function as required.

The roller type stacker assembly 1 operates in the following manner as illustrated with reference FIGS. 2(A)–2(G) and 6.

A workpiece 3 is disposed on a forward moving conveyor flight 2. The conveyor flight 2 advances toward the roller type stacker assembly 1 in a direction represented by the arrow A. As the flight approaches the roller type stacker assembly 1, the roller 6 is already raised by the double-acting cylinders 14 to a stand-by position with the lower portion of the roller 6 within the defined path of the conveyor. (Step S1).

As the forward moving conveyor flight 2 approaches the roller type stacker assembly 1, its presence is detected by the flight sensor 16 upon reflection of light from the second reflection area 18 of the conveyor flight 2. (Step S2). Upon this condition, the controller 4 activates the workpiece sensor 15 for detecting the leading edge of a workpiece on the detected flight (Step S3). The advancing flight then engages the lower portion of roller 6. At this stage, the roller 6 assumes a rotational speed that is consistent with the longitudinal speed of the advancing flight before it reaches a supported workpiece. The pivot arms 10 react to the force of the torsion spring 13 to urge the roller 6 against the upper surface of the forward moving flight and to absorb the force of the roller 6 rebounding from the initial impact. Having the roller 6 achieve the desired rotational speed before reaching a supported workpiece decreases the likelihood of wrinkles, creases or misalignment. If a workpiece is not present, the roller 6 rides along the upper surface of the flight until it passes the flight's trailing edge at which time the pneumatic cylinders 14, since engaged, return the roller 6 to the stand-by position.

Figure 2A:
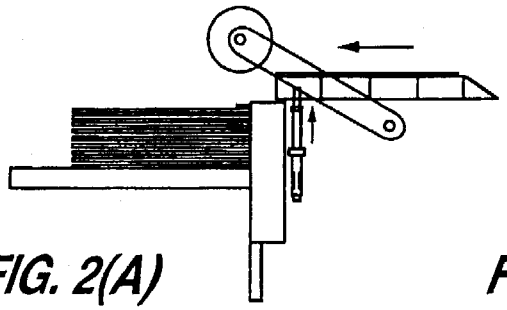
FIGS. 2(A)–2(G) are a progression of side views showing operation of the roller type stacker of FIG. 1.
Figure 2B:
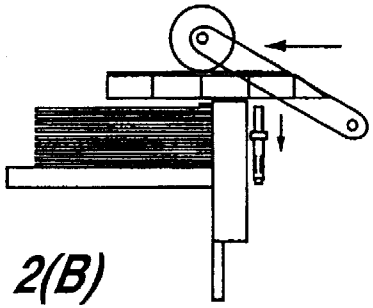
Figure 2C:
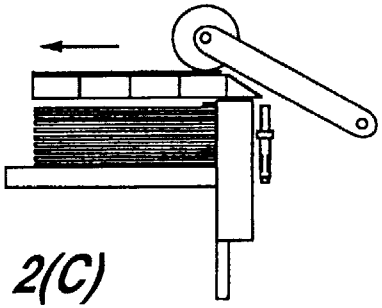

Once the flight sensor 16 and workpiece sensor 15 have confirmed a loaded flight, the controller 4 deactivates the double-acting pneumatic cylinders 14. (Step S4). Upon detecting the trailing edge of the workpiece, the brake 7 is activated to stop rotation of the roller 6. (Step S5). This condition is shown in FIG. 2(C). As the roller 6 stops, the loaded flight continues forward while the longitudinal movement of the engaged workpiece 3 ceases. The roller 6 drags the workpiece 3 from the advancing conveyor flight 2 as it continues forward. During this process, the torsion spring 13 (assisted by the O-rings 27) exerts sufficient force on the roller 6 to overcome any frictional force between the conveyor flight 2 and the workpiece 3.

Figure 2D:
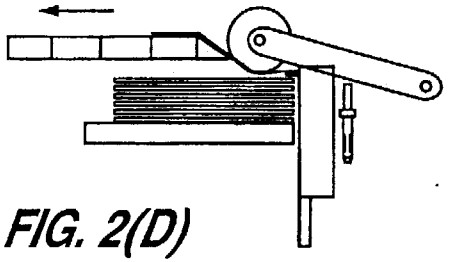

As shown in FIG. 2(D), the trailing edge of the flight has now advanced past the stack and is leaving the immediate area of the roller type stacker assembly 1. As the trailing edge 20 passes the roller type stacker assembly 1, the roller 6 travels down the sloped trailing edge of the forwardly advancing conveyor flight 2 directing the engaged workpiece 3 against the top of the stacker 5 and the hold-down finger 25 of the hold-down mechanism 9. The edge of the engaged workpiece 3 is aligned with the edge of the stacker 5 to create a stack of workpieces.

The roller 6 remains in constant contact with the workpiece even as it is dragged from the flight as shown in FIG. 2(C). The roller 6 is designed to have a diameter that enables it to bridge the gap between the flight and the top of the stack as it drags a workpiece from the conveyor. Thus, the roller 6 continues to hold the workpiece in position against the sloped trailing end of the flight as it is contacts the stack S.

Figure 2E:
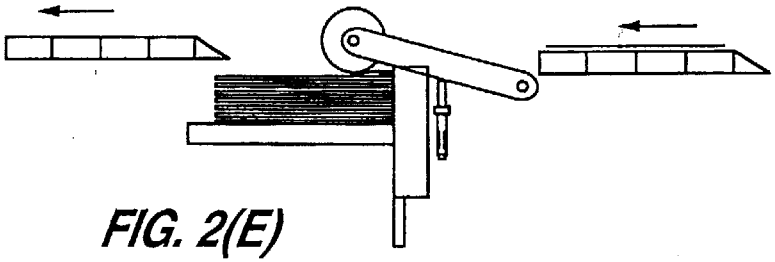
Figure 2F:
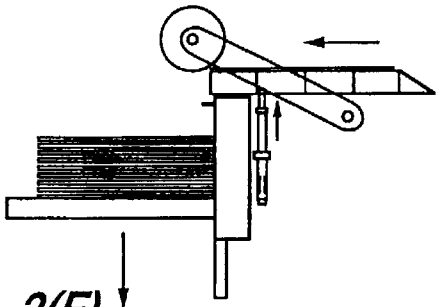

As shown in FIG. 2(E), the trailing edge 20 of the advancing flight has now almost cleared the stacker 5 and the next advancing flight is approaching the roller type stacker assembly 1.

Upon detecting the trailing edge of the next flight, the controller 4 simultaneously causes the elevator 21 to descend, the double-acting cylinders 14 to push the pivot arms 10 upward raising the roller 6 to the stand-by position and the brake 7 to release. (Steps S7 and S8).

Figure 2G:
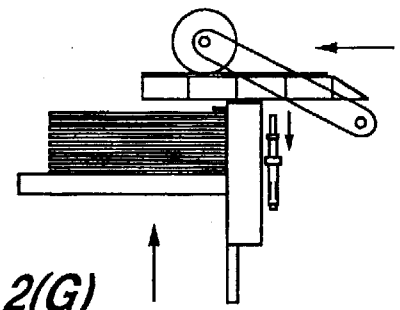

As shown in FIG. 2(G), it is determined if the stack S is properly positioned. (Step 9) If not, the controller 4 causes the elevator 21 to move upward bringing the most recently unloaded workpiece 3 into contact with the hold-down finger 25 until the stacker 5 is placed in the proper position with respect to the conveyor and roller 6 in preparation for repeating the process.

Although the disclosed apparatus and method are well suited for handling limp material workpieces, they may be used with other materials having similar properties.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for transferring workpieces from a conveyor to stack having at least one flight forwardly traveling in a defined path, said flight being capable of carrying one of said workpieces thereon, the apparatus comprising:

means for stacking a plurality of workpieces in a stack as removed from said conveyor, said stacking means being positioned below the path of said at least one forwardly traveling flight;

means for transferring an individual workpiece from an upper surface of the at least one forwardly traveling flight to said stacking means by engaging an upwardly facing surface of the workpiece to impede the forward motion of the engaged workpiece as the flight continues forward, said transferring means comprising a rotatable engaging means for rotatably engaging an individual workpiece against the upper surface of the at least one forwardly traveling flight at a rotational speed substantially the same as the forward speed of the at least one forwardly moving flight; and braking means for selectively stopping rotation of said rotatable engaging means to impede the forward movement of the engaged workpiece as the at least one forwardly traveling flight continues forward.

2. An apparatus for transferring workpieces to a stack as recited in claim 1, further comprising:

shock-absorbing means for dampening vibration of the rotatable engaging means by absorbing a force generated upon contact of the rotatable engaging means with the at least one forwardly traveling flight while urging said rotatable engaging means toward the upper surface of the flight and the upwardly facing surface of a workpiece positioned thereon.

3. An apparatus for transferring workpieces to a stack as recited in claim 2, wherein said rotatable engaging means comprises:

a roller suspended on an axis disposed within a cylindrical bore in said roller; and roller support means for securing the axis while allowing the roller to rotate freely about the axis.

4. An apparatus for transferring workpieces to a stack as recited in claim 3, wherein said shock absorbing means comprises a torsion spring engaged with said roller support means.

5. An apparatus for transferring workpieces to a stack as recited in claim 1, wherein said rotatable engaging means further comprising:

means for absorbing a force generated upon contact of the rotatable engaging means with the at least one forwardly traveling flight and for urging said rotatable engaging means toward the upper surface of the flight and the upwardly facing surface of a workpiece positioned thereon, and contact means, on a circumferential surface of said rotatable engaging means for increasing frictional contact between the rotatable engaging means and the at least one forwardly moving flight and a workpiece supported on said at least one forwardly moving flight.

6. An apparatus for transferring workpieces to a stack as recited in claim 5, wherein said contact means comprises a plurality of O-rings disposed in a plurality of circumferential grooves formed within the circumferential surface of the rotatable engaging means.

7. An apparatus for transferring pieces to a stack as recited in claim 5, wherein the means for absorbing a force is a torsion spring.

8. An apparatus for transferring workpieces to a stack, as recited in claim 1, further comprising:

means for moving the rotatable engaging means between a loading position with respect to the defined path of the at least one forwardly traveling flight and an unloading position with respect to the stack.

9. An apparatus for transferring workpieces to a stack, as recited in claim 8, wherein said moving means includes at least one pneumatic cylinder for pushing an upper half of the rotatable engaging means above the path of the forward traveling flights.

10. An apparatus for transferring workpieces to a stack according to claim 1, further comprising:

hold down means for determining the position of the stack with respect the defined path of the at least one forward traveling flight; and means for controlling said stacking means to raise and lower said stack to a selected position in response to said hold down means.

11. An apparatus for transferring workpieces to a stack according to claim 10, wherein said hold down means comprises:

a guide chamber;

a shaft disposed within a cylindrical bore in the guide chamber;

a hold down finger disposed on one end of the shaft for engaging a top workpiece in the stack;

means for urging the hold down finger into engagement with the stack; and proximity switch means for determining the position of the top of the stack with respect to the defined path of the at least one forwardly traveling flight by detecting the position of the shaft and hold-down finger with respect to the top of the stack.

12. An apparatus for transferring workpieces to a stack as recited in claim 1, wherein said stacking means further comprises:

elevator means for raising and lowering said stack with respect to the path of the traveling flights.

13. An apparatus for transferring workpieces to a stack as recited in claim 1, wherein said braking means is an electric brake.

14. A method of transferring and stacking workpieces from a conveyor having at least one forward moving flight in a defined path with an upper surface for supporting a workpiece thereon, the steps comprising:

detecting the presence of a flight;

after said flight detecting step, detecting a leading edge of a workpiece supported on the detected flight;

upon detection of a flight and the leading edge of a workpiece, engaging the supported workpiece with a roller type engaging member at a rotational speed substantially the same as the longitudinal speed of the detected flight;

stopping the rotation of the roller type engaging member for impeding the forward progress of the engaged workpiece as the detected flight continues forward; and dragging the engaged workpiece from the advancing flight onto a stack.

15. A method of transferring and stacking workpieces as recited in claim 14, further comprising detecting a trailing edge of the positioned workpiece prior to said stopping the rotation of the roller type engaging member.

16. A method of transferring and stacking workpieces as recited in claim 14, said engaging step comprising engaging the upper surface of the at least one forwardly moving flight for enabling the roller type engaging member to achieve a rotational speed substantially the same as the longitudinal speed of the detected flight prior to engaging the positioned workpiece.

* * * * *